US005904109A

United States Patent [19]

Asano

[11] Patent Number: 5,904,109

[45] Date of Patent: May 18, 1999

[54] COLOR SWITCH SETTING DATA PROCESSING APPARATUS FOR MULTI-NEEDLE EMBROIDERY MACHINE AND SEWING SYSTEM EMPLOYING THE APPARATUS

[75] Inventor: Fumiaki Asano, Nagoya, Japan

[73] Assignee: Brother Kogyo Kabushiki Kaisha, Nagoya, Japan

[21] Appl. No.: 09/167,843

[22] Filed: Oct. 8, 1998

[30] Foreign Application Priority Data

Oct. 8, 1997 [JP] Japan ..... 9-293440

[51] Int. Cl.[6] ..... D05C 5/02

[52] U.S. Cl. ..... 112/102.5; 112/155; 112/163; 112/470.04; 364/470.09

[58] Field of Search ..... 112/102.5, 470.06, 112/155, 163, 167, 164, 165, 166, 470.04; 364/470.09, 470.07, 470.08

[56] References Cited

U.S. PATENT DOCUMENTS 4,776,291 10/1988 Tajima et al. ..... 112/98

5,218,916 6/1993 Kurono et al. ..... 112/155 X

*Primary Examiner*—Peter Nerbun

*Attorney, Agent, or Firm*—Oliff & Berridge, PLC

[57] ABSTRACT

A color switch setting data processing apparatus for a multi-needle embroidery machine is provided by a personal computer or other data processing device. The apparatus causes a display unit to display a stitching sequence and needle bar numbers for color switch setting data. If an insert instruction is produced by indicating the place of insertion by using a cursor and a needle bar number to be inserted is inputted to the place, then the color switch setting data is rewritten by shifting the needle bar number data from the place of insertion and the subsequent places in the stitching sequence, by one place to a later side in the stitching sequence. If a deletion instruction is produced by indicating the place of deletion by using the cursor, the color switch setting data is rewritten by shifting the needle bar number data in the places subsequent, on the later side, to the place of deletion, by one place to an earlier side in the stitching sequence. Thus, the apparatus enables easy insertion of a needle bar number into any place in the stitching sequence and easy deletion of a needle bar number from any place in the stitching sequence in the color switch setting data prepared for a multi-needle embroidery machine.

20 Claims, 11 Drawing Sheets

Fig.5

| STITCHING SEQUENCE | NEEDLE BAR CODE | NEEDLE BAR NO. DATA |
|---|---|---|
| 1 | NDL[0] | 1 |
| 2 | NDL[1] | 3 |
| 3 | NDL[2] | 4 |
| 4 | NDL[3] | 2 |
| 5 | NDL[4] | 7 |
| 6 | NDL[5] | 9 |
| 7 | NDL[6] | 5 |
| 8 | NDL[7] | 4 |
| 9 | NDL[8] | 6 |
| — | — | — |
| — | — | — |
| — | — | — |
| — | — | — |
| — | — | — |
| M | NDL[M-1] | 5 |

| | | | | | | | | | | | | |
|---|---|---|---|---|---|---|---|---|---|---|---|---|
| STITCHING SEQUENCE | 1 | 2 | 3 | 4 | 5 | 6 | 7 | 8 | 9 | -- | - | M |
| NEEDLE BAR NO. | 1 | 3 | 4 | 2 | 7 | 9 | 5 | 4 | 6 | -- | - | 5 |
| COUNTER I | 0 | 1 | 2 | 3 | 4 | 5 | 6 | 7 | 8 | -- | -- | M-1 |
| CURSOR POSITION | 1 | 2 | 3 | 4 | 5 | 6 | 7 | 8 | 9 | - | -- | M |

| STITCHING SEQUENCE | 1 | 2 | 3 | 4 | 5 | 6 | 7 | 8 | 9 | -- | - | M+1 |
|---|---|---|---|---|---|---|---|---|---|---|---|---|
| NEEDLE BAR NO. | 1 | 3 | 4 | 9 | 2 | 7 | 9 | 5 | 4 | -- | - | 5 |
| COUNTER I | 0 | 1 | 2 | 3 | 4 | 5 | 6 | 7 | 8 | -- | -- | M |
| CURSOR POSITION | 1 | 2 | 3 | 4 | 5 | 6 | 7 | 8 | 9 | - | -- | M+1 |

| | | | | | | | | | | | | |
|---|---|---|---|---|---|---|---|---|---|---|---|---|
| STITCHING SEQUENCE | 1 | 2 | 3 | 4 | 5 | 6 | 7 | 8 | 9 | -- | - | M-1 |
| NEEDLE BAR NO. | 1 | 3 | 4 | 7 | 9 | 5 | 4 | 6 | 2 | -- | - | 5 |
| COUNTER I | 0 | 1 | 2 | 3 | 4 | 5 | 6 | 7 | 8 | -- | -- | M-2 |
| CURSOR POSITION | 1 | 2 | 3 | 4 | 5 | 6 | 7 | 8 | 9 | - | -- | M-1 |

COLOR SWITCH SETTING DATA PROCESSING APPARATUS FOR MULTI-NEEDLE EMBROIDERY MACHINE AND SEWING SYSTEM EMPLOYING THE APPARATUS

BACKGROUND OF THE INVENTION

1. Field of Invention

The invention relates to a color switch setting data processing apparatus for a multi-needle embroidery machine, and a stitching system employing the apparatus and, more particularly, to a color switch setting data processing apparatus making it possible to easily change the color switch setting data, and a stitching system employing the apparatus.

2. Description of Related Art

A multi-needle embroidery machine has a needle bar case that is provided with a plurality of needle bars and needles, a needle bar selector mechanism for moving the needle bar case so as to set a needle bar to be used for stitching, at a stitching position, and a spool table provided with a plurality of upper threads of different colors that are led to and carried by different needles. A typical embroidery design is made up of a plurality of different component color design parts. Each component color design part is formed by the corresponding color thread. The stitch data for forming an embroidery design is stored in the order of the stitch data regarding the first component color design part to be formed, the stitch data regarding the second component color design part to be formed, the stitch data regarding the third component color design part to be formed, the stitch data regarding the fourth component color design part to be formed, the stitch data regarding the fifth component color design part to be formed, and so on.

In order to form a plurality of component color design parts of each embroidery design, it is necessary to designate a needle bar (that is, an upper thread) for each component color design part and precisely select the designated needle bars during an actual embroidery operation. The correspondence between the needle bars and the thread colors may well change, if spools on the spool table are replaced. Therefore, in preparation for an embroidery operation, an operator, while checking the needle bar ID numbers in the needle bar case and the thread colors to be used, prepares a color switch setting data card in which the stitching sequence for forming a plurality of component color design parts of each embroidery design and the needle bar ID numbers of the needle bars used for the respective component color design parts are set. The color switch setting data in the card is inputted and stored into a color switch setting data processing apparatus formed by, for example, a personal computer or the like.

During a stitch data editing operation, color switch codes for instructing a color switch and needle bar codes (or needle bar ID number data) for designating a needle bar to be used for each component color design part are written into a leading area of the stitch data about each component color design part stored in a memory. Therefore, the stitching of the component color design parts of the embroidery design is performed in a predetermined sequence based on the stitch data stored in the memory. The stitching of each component color design part is started after the needle bar (thread color) corresponding to the component color design part is selected.

The color switch setting data can be inputted from the card into the color switch setting data processing apparatus while the color switch setting data is displayed in the form of a table on a display. If there occurs a need to insert a needle bar ID number into or delete one from the color switch setting data while the color switch setting data table is displayed, the conventional color switch setting data processing apparatus does not allow an operator to insert or delete a needle bar ID number. In order to make such a change in the needle bar ID number data, the operator must also delete and re-input all the needle bar ID number data listed after the place of the number data to be inserted or deleted.

Such a data changing operation may not be very hard if the number of component color design parts is small as in a case where the embroidery design is small in size. However, in the case of a complicated embroidery design that requires several dozens of color switch operations, the re-inputting of needle bar ID number data due to the insertion or deletion of a needle bar ID number consumes considerable amounts of labor and time, thereby reducing the operation efficiency. Moreover, because there is a possibility of a mistake in re-inputting needle bar ID number data, the reliability of color switch setting data deteriorates, and it becomes necessary to re-check the needle bar ID number data after the data is re-inputted.

SUMMARY OF THE INVENTION

Accordingly, it is an object of the invention to enable easy insertion of needle bar ID identifier data into color switch setting data and easy deletion of needle bar ID identifier data from the color switch setting data in a color switch setting data processing apparatus.

According to one aspect of the invention, there is provided a color switch setting data processing apparatus for a multi-needle embroidery machine, for processing color switch setting data to be used for an embroidery operation performed by the multi-needle embroidery machine. The color switch setting data processing apparatus includes an input device, a display device including a display, and a color switch setting data storing device for storing a stitching sequence for forming a plurality of component color design parts of an embroidery design, and needle bar identifiers (preferably needle bar numbers) of needle bars to be used for the individual component color design parts, in correspondence with each other. A display control device is provided for receiving data regarding the stitching sequence and the needle bar identifiers from the color switch setting data storing device, and for displaying, on the display, the stitching sequence and the needle bar identifiers in correspondence with each other. An insertion instruction device is provided for providing an instruction to insert a needle bar identifier into any place in the stitching sequence displayed by the display device. If the instruction to insert a needle bar identifier is provided by the insertion instruction device, needle bar identifier data in the color switch setting data storing device is rewritten by the insertion data update device. By the action of the insertion data update device, the needle bar identifier data in the place of insertion of the needle bar identifier based on the instruction and subsequent places are shifted by one place to a later side in the stitching sequence, and the needle bar identifier data inputted by the input device into the place of insertion based on the instruction is written into the color switch setting data storing device.

The color switch setting data processing apparatus is formed by, for example, a personal computer or the like. The apparatus is provided with the input device and the display device including the display. In a stage of preparing stitch data for an embroidery design, color switch setting data is prepared in the form of a card. In the color switch setting data, the stitching sequence and the needle bar identifiers of the needle bars to be used for the individual component color design parts are associated with each other. The color switch setting data is stored into the color switch setting data storing device, through the input device. The display control device receives the color switch setting data from the color switch setting data storing device and causes the display of the display device to display the stitching sequence and the needle bar identifiers in correspondence with each other.

When an operator needs to insert a needle bar identifier into a place in the stitching sequence while looking at the color switch setting data displayed on the display, the operator designates the place of insertion through the insertion instruction device so that an insertion instruction is produced. In response, by the insertion data update device, the color switch setting data is rewritten by shifting the needle bar identifier data in the place of insertion and the subsequent places in the stitching sequence, by one place to a later side in the stitching sequence. Furthermore, the needle bar identifier data inputted to the insertion place is written into the color switch setting data storing device by the insertion data update device. In this manner, the color switch setting data is updated to the data that includes the needle bar identifier inserted at the designated place.

Therefore, the data in the color switch setting data storing device can be updated by a simple operation of the operator providing an instruction to insert a needle bar identifier into a desired place in the stitching sequence and inputting, through the input device, the needle bar identifier to be inserted, while looking at the displayed set of the stitching sequence and the needle bar identifiers prepared regarding a plurality of component color design parts. Consequently, the operating efficiency in inserting a needle bar identifier during the color switch setting data processing can be considerably improved, and the reliability of the color switch setting data after the insertion of a needle bar identifier can be improved.

The color switch setting data processing apparatus may further include a deletion instruction device for providing an instruction to delete a needle bar identifier from any place in the stitching sequence displayed by the display device, and a deletion data update device for, if the instruction to delete a needle bar identifier is provided by the deletion instruction device, rewriting needle bar identifier data in the color switch setting data storing device by shifting the needle bar identifier data in places subsequent, on the later side, to the place of deletion based on the instruction, by one place to an earlier side in the stitching sequence.

Therefore, when the operator needs to delete a needle bar identifier from a place in the stitching sequence while looking at the color switch setting data displayed on the display, the operator designates the place of deletion through the deletion instruction device so that a deletion instruction is produced. In response, by the deletion instruction device, needle bar identifier data in the color switch setting data storing device is rewritten by shifting the needle bar identifier data in places subsequent, on the later side, to the place of deletion based on the instruction, by one place to the earlier side in the stitching sequence. In this manner, the color switch setting data is updated to the data in which the needle bar identifier has been deleted from the designated place.

Therefore, the data in the color switch setting data storing device can be updated by a simple operation of an operator providing an instruction to delete a needle bar identifier from a desired place in the stitching sequence while looking at the displayed set of the stitching sequence and the needle bar identifiers prepared regarding a plurality of component color design parts. Consequently, the operating efficiency in deleting a needle bar identifier during the color switch setting data processing can be considerably improved, and the reliability of the color switch setting data after the deletion of a needle bar identifier can be improved.

According to another aspect of the invention, there is provided a color switch setting data processing apparatus for a multi-needle embroidery machine, for processing color switch setting data to be used for an embroidery operation performed by the multi-needle embroidery machine. The color switch setting data processing apparatus includes an input unit, a display unit including a display, and a color switch setting data storage that stores a stitching sequence for forming a plurality of component color design parts of an embroidery design, and needle bar identifiers of needle bars to be used for the individual component color design parts, in correspondence with each other. Furthermore, a display controller receives data regarding the stitching sequence and the needle bar identifiers from the color switch setting data storage, and causes the display of the display unit to display the stitching sequence and the needle bar identifiers in correspondence with each other. An insertion instruction unit is operated to provide an instruction to insert a needle bar identifier into any place in the stitching sequence displayed on the display. If the instruction to insert a needle bar identifier is provided through the insertion instruction unit, an insertion data update unit rewrites needle bar identifier data in the color switch setting data storage by shifting the needle bar identifier data in the place of the insertion of the needle bar identifier instructed and subsequent places, by one place to a later side in the stitching sequence. The insertion data update unit also writes the needle bar identifier data inputted through the input unit into the place of the insertion instructed, into the color switch setting data storage.

The color switch setting data processing apparatus may further include a deletion instruction unit that provides an instruction to delete a needle bar identifier from any place in the stitching sequence displayed on the display, and a deletion data update unit, if the instruction to delete a needle bar identifier is provided through the deletion instruction unit, rewrites needle bar identifier data in the color switch setting data storage by shifting the needle bar identifier data in places subsequent, on the later side, to the place of the deletion based on the instruction, by one place to the earlier side in the stitching sequence.

According to still another aspect of the invention, there is provided a stitching system including a multi-needle embroidery machine, and a color switch setting data processing apparatus for the multi-needle embroidery machine. The color switch setting data processing apparatus includes an input unit, a display unit including a display, and a color switch setting data storage that stores a stitching sequence for forming a plurality of component color design parts of an embroidery design, and needle bar identifiers of needle bars to be used for the individual component color design parts, in correspondence with each other. Furthermore, in the data processing apparatus, a display controller receives data regarding the stitching sequence and the needle bar identifiers from the color switch setting data storage and causes the display of the display unit to display the stitching sequence and the needle bar identifiers in correspondence with each other, and an insertion instruction unit is operated to provide an instruction to insert a needle bar identifier into any place in the stitching sequence displayed on the display. If the instruction to insert a needle bar identifier is provided through the insertion instruction unit, an insertion data update unit rewrites needle bar identifier data in the color switch setting data storage by shifting the needle bar identifier data in the place of the insertion of the needle bar identifier instructed and subsequent places, by one place to a later side in the stitching sequence. The insertion data update unit also writes the needle bar identifier data inputted through the input unit into the place of the insertion instructed into the color switch setting data storage.

In the stitching system, the color switch setting data processing apparatus for the multi-needle embroidery machine may further include a deletion instruction unit that provides an instruction to delete a needle bar identifier from any place in the stitching sequence displayed on the display, and a deletion data update unit, if the instruction to delete a needle bar identifier is provided through the deletion instruction unit, rewrites needle bar identifier data in the color switch setting data storage by shifting the needle bar identifier data in places subsequent, on the later side, to the place of the deletion based on the instruction, by one place to an earlier side in the stitching sequence.

BRIEF DESCRIPTION OF THE DRAWINGS

A preferred embodiment of the invention will be described in detail with reference to the following figures wherein:

FIG. 5 is a diagram illustrating the structure of a color switch setting data table;

DETAILED DESCRIPTION OF PREFERRED EMBODIMENTS

A preferred embodiment of the invention will be described in detail hereinafter with reference to the accompanying drawings.

Figure 1:
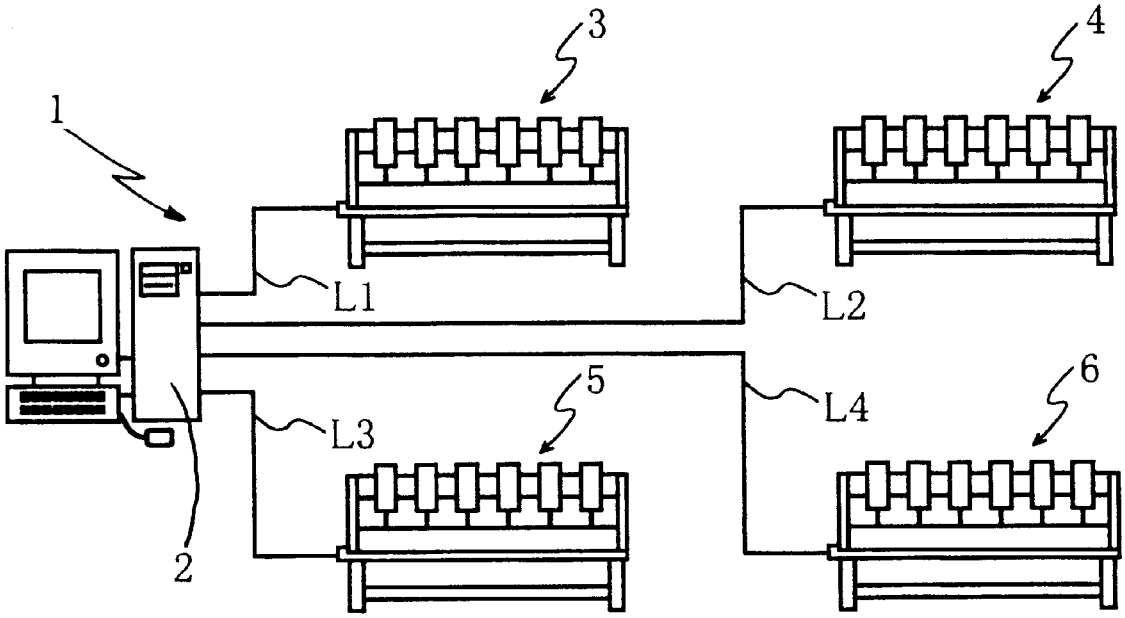
FIG. 1 illustrates the structure of a stitching system according to a preferred embodiment of the invention.

In the embodiment, the invention is applied to a stitching system wherein an external personal computer is connected to four embroidery machines that receive embroidery data from the personal computer and form various embroidery designs on work cloths retained in retaining frames. Referring to FIG. 1, in a stitching system 1, a personal computer 2 is connected to four embroidery machines 3–6 (multi-needle embroidery machines) by individually dedicated connecting lines L1–L4. Each of the embroidery machines 3–6 is a 6-unit machine in which six embroidering units are arranged. Therefore, each embroidery machine 3–6 is able to simultaneously form identical embroidery designs on six work cloths retained respectively by six embroidery frames mounted on a movable frame (not shown).

Figure 2:
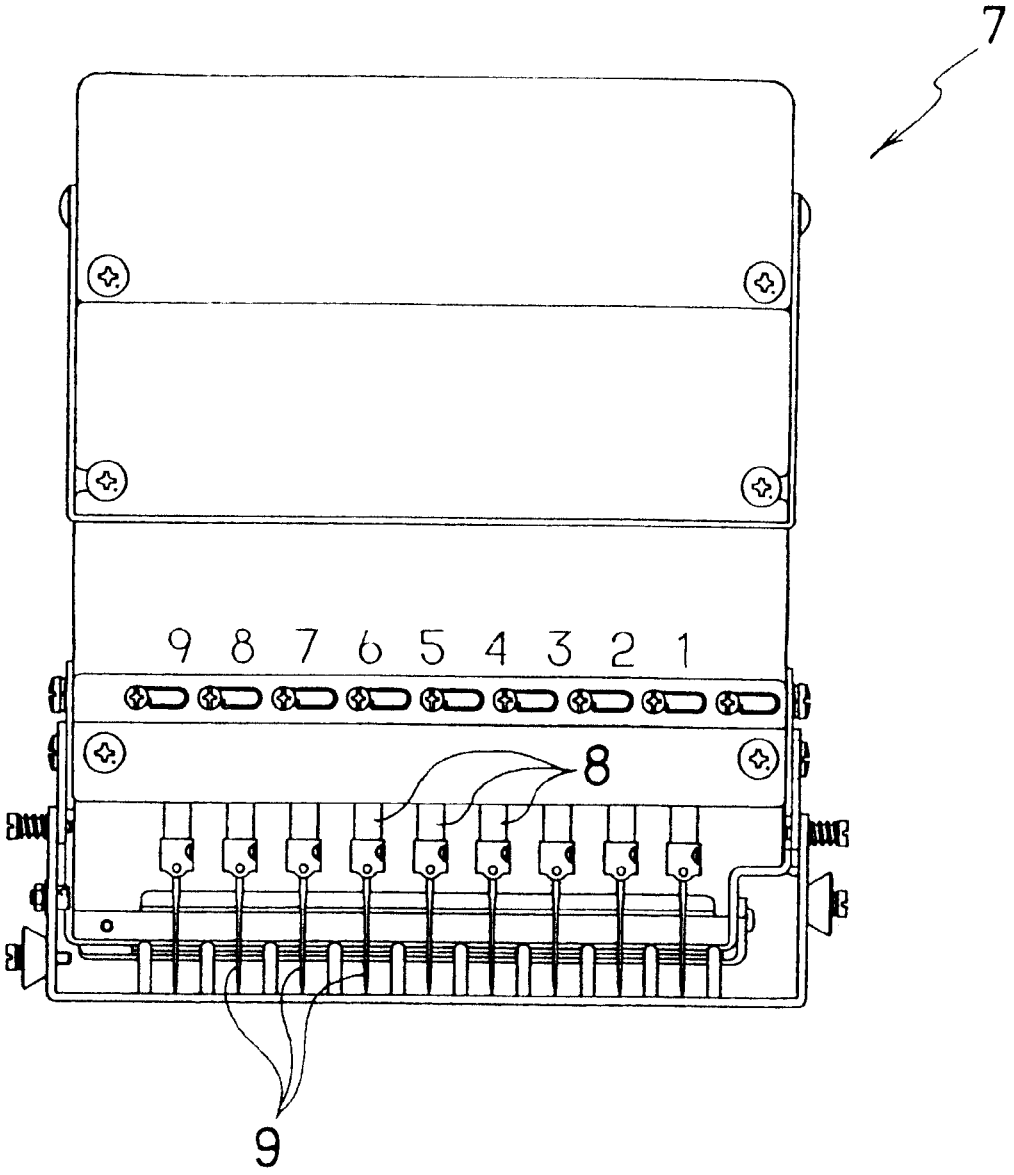
FIG. 2 is a front elevation of a needle bar case of a multi-needle embroidery machine.

Referring now to FIG. 2, each needle bar case 7 of each embroidery machine 3–6 has needle bars 8 (for example, nine needle bars), each of which holds in its lower end portion a needle 9. The nine needles 9 are supplied with upper threads of different colors from nine spools supported on a spool table. The needle bar case 7 is switched in position so as to position a needle bar 8 selected by a needle bar selector mechanism, at a stitching position, relative to the embroidery frame, so that the needle bar 8 can be used for stitching.

Figure 3:
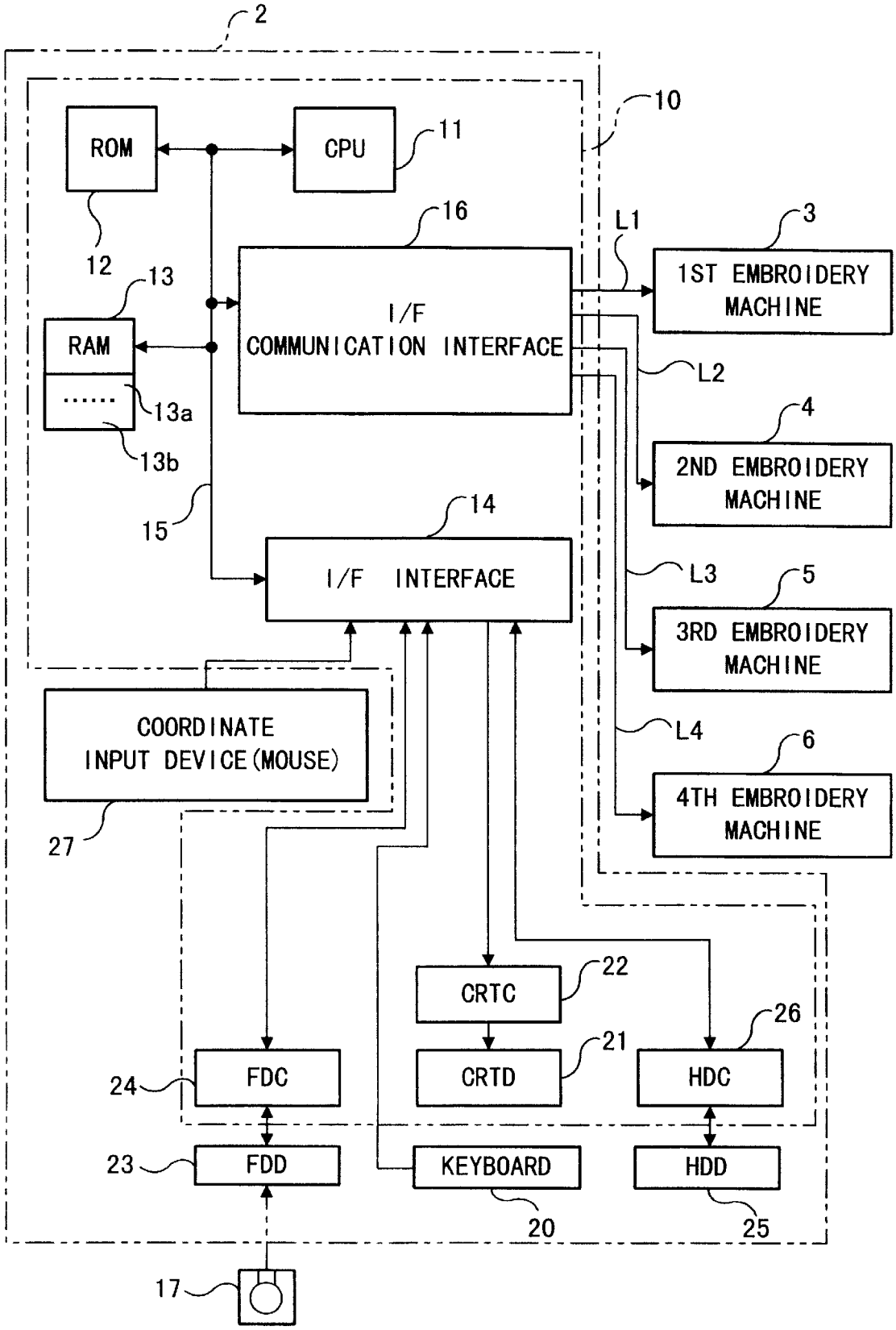
FIG. 3 is a block diagram of a control system of a personal computer.

A control system of the personal computer 2 (constituting a color switch setting data processing apparatus for a multi-needle embroidery machine) will be described with reference to the block diagram of FIG. 3. A host controller 10 is substantially made up of a CPU 11; a ROM 12 and a RAM 13 connected to the CPU 11 by buses 15, such as a data bus; an input/output interface 14; a communication interface 16 separately connected to each of the first to fourth embroidery machines 3–6; a CRT controller 22 for outputting display data to a CRT display 21; a floppy disk drive (FDD) controller 24 for controlling and driving a floppy disk drive (FDD) 23; and a hard disk drive (HDD) controller 26 for controlling and driving a hard disk drive (HDD) 25. The CRT controller 22, the FDD controller 23 and the HDD controller 26 are connected to the input/output interface 14.

The communication interface 16 is formed by, for example, a Centronics® interface, or the like, so that it is capable of two-way data communication. The input/output interface 14 is connected to a keyboard 20 for inputting characters, symbols and the like, and a coordinate input device (generally termed mouse) 27. The ROM 12 stores a start program for starting the personal computer 2 at the time of power-on, as in a typical personal computer.

A hard disk mounted in the HDD 25 stores various operating systems (OS), such as MS-DOS®, Windows® and the like, and, further, various application programs, such as a word processor, graphics software, and communication control programs for data transmission and reception with an external terminal device (the four embroidery machines 3–6 in this embodiment), as needed and space allows. The hard disk also stores various control programs for, for example, design selection control, design modification processing, display control, color switch setting data preparation, described later, and the like.

Figure 4:
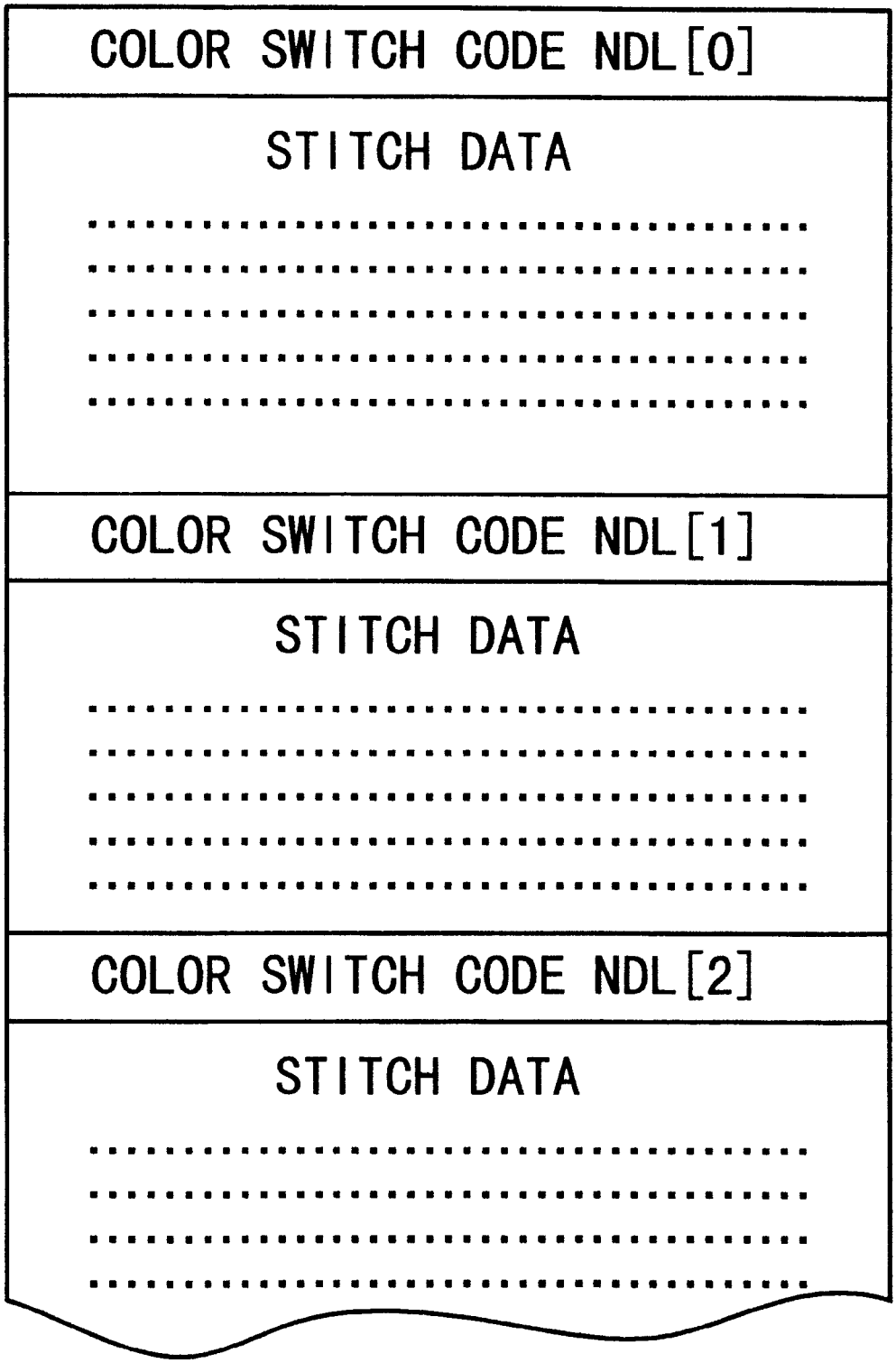
FIG. 4 is a diagram illustrating the structure of stitch data for an embroidery design.

A floppy disk 17, removably inserted into the FDD 23, stores data regarding many embroidery designs classified into a plurality of groups according to the types of designs. The data regarding each embroidery design includes design display data and stitch data. Since an ordinary embroidery design is made up of a plurality of component color design parts, the stitch data of each embroidery design is stored together with, as shown in FIG. 4, a color switch code for instructing a color switch in accordance with the classification of the component color design parts and a needle bar code indicated by NDL[ ]. The "component color design part" means a design part that is continuously stitched using a single upper thread.

The floppy disk 17 also stores a color switch setting data table, as illustrated in FIG. 5, which is inputted beforehand. The color switch setting data table stores at least the needle bar codes for indicating the stitching sequence and the needle bar ID number data that are arranged in correspondence with each other. The color switch setting data table is created by inputting the data from a color switch setting data card prepared separately for the individual embroidery designs in a stitching preparation stage. At the time of a color switch for each component color design part during a stitching operation, a needle bar number is determined on the basis of the needle bar code as shown in FIG. 4 and the color switch setting data table as shown in FIG. 5. Instead of the needle bar codes, needle bar number data corresponding to needle bar codes may be written into the memory.

In one embodiment, the floppy disk 17 stores the control programs, and the FDD 23 reads out (or uploads) the control programs to the system. The control programs may be stored on the hard disk in the HDD 25. Alternatively, any of the operating systems, applications programs, control programs, data and tables described above may be stored on a hard disk (or other fixed storage medium), a floppy disk (or other removable storage medium) or other suitable storage medium.

The RAM 13 has a data memory 13*a* for storing various transmission data, such as embroidery data and the like, a work memory 13*b*, and the like. A memory portion of the work memory 13*b* stores identification number data specific to the first to fourth embroidery machines 3–6 that are transmitted from the embroidery machines 3–6. The RAM 13 is constantly backed up by a battery so as to retain the stored contents.

The first to fourth embroidery machines 3–6 are controlled by identical control devices. The control device of each embroidery machine is substantially made up of a microcomputer, an input/output interface, a communication interface connected to the personal computer 2, and the like. The input/output interface is connected separately to a drive circuit for an X-direction drive motor that moves the embroidery frame in the X directions (right-left directions), a drive circuit for a Y-direction drive motor that moves the embroidery frame in the Y directions (forward and backward), a drive circuit for a machine motor that drives the six machine units, and an operating panel that has a small-size display, indicator lamps, various switches and the like.

Figure 6:
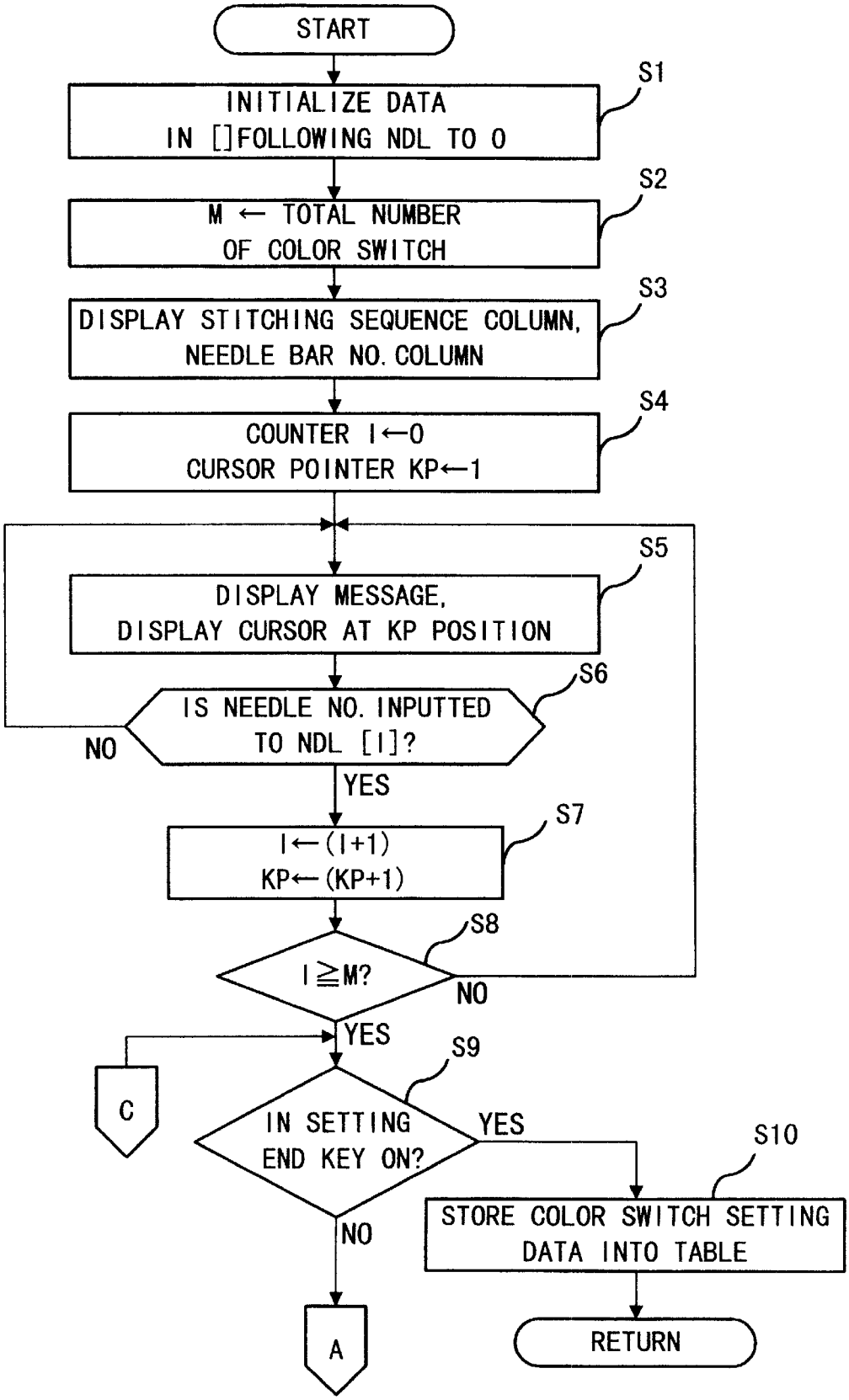
FIGS. 6–8 are a flowchart for a routine of color switch setting data preparation control.
Figure 7:
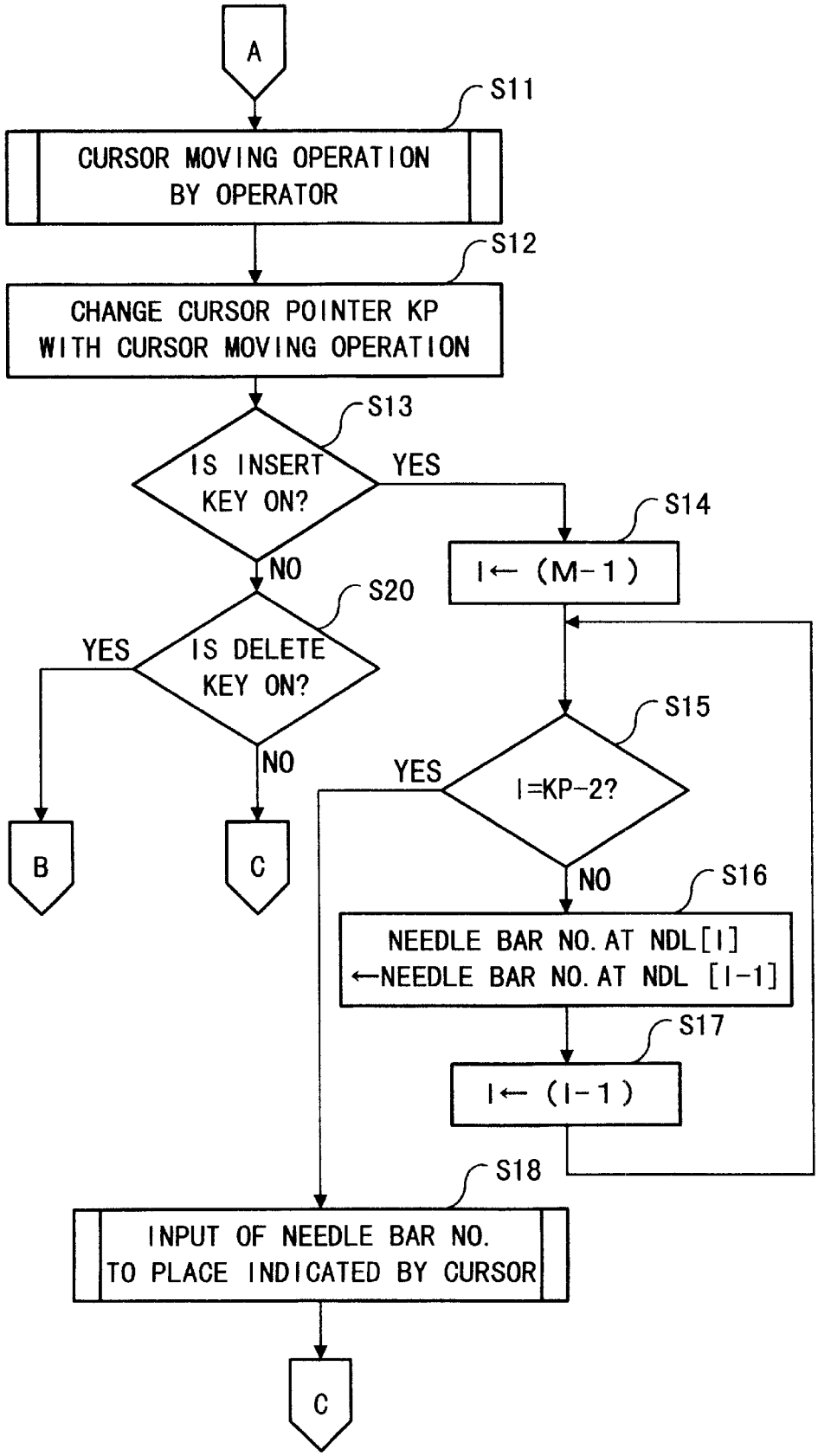
Figure 8:
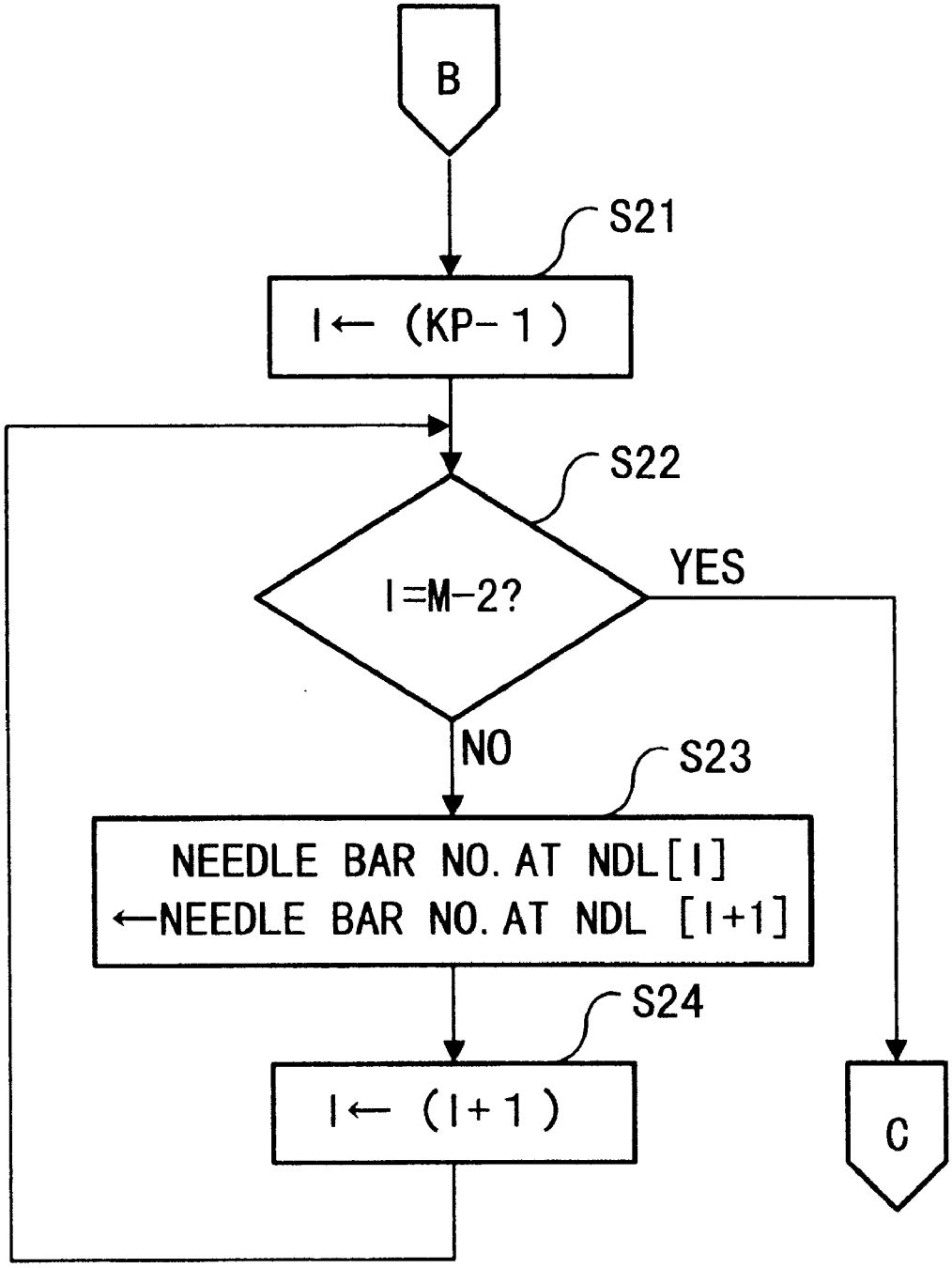

A routine of color switch setting data preparation will be described using the flowcharts of FIGS. 6 through 8, the table of FIG. 9, and the diagram of FIG. 10. In the color switch setting data preparation, a color switch setting data table is created by inputting the needle bar number data from a color switch setting data card prepared beforehand regarding an embroidery design (having a plurality of component color design parts), and the color switch setting data table is corrected by inserting or deleting a needle bar number.

When this control routine is started, the data in the brackets [ ] following NDL in each needle bar code in the color switch setting data table is initialized to "0". Subsequently in step S2, the total number of color switches is set as M. In step S3, the column for stitching sequence and the column for needle bar numbers are displayed on the CRT display 21, as shown in FIG. 10. In reality, needle bar numbers are not displayed until they are inputted. FIG. 9 is a table indicating the relationship among a stitching sequence, input needle bar numbers, counter I and the position of a cursor K (that is counted by a cursor pointer KP). The counter I corresponds to the value in the brackets following NDL in each needle bar code. When a counter I is determined, a needle bag code NDL[I] is also determined.

Subsequently in step S4, the counter I is initialized to) "0", and the cursor pointer KP is initialized to "1". In step S5, a message advising an operator to input needle bar numbers beginning with the needle bar number that comes first in the stitching sequence is displayed on the CRT display 21, and the cursor K is displayed at a position or place pointed by the cursor pointer KP. After that, it is determined in step S6 whether a needle bar number has been entered into the place of NDL[I] indicated by the cursor K (that is, the place of the counter I). If the determination is NO, the operation returns to step S5, so that steps S5 and S6 are repeated. When the determination in step S6 becomes YES, the operation proceeds to step S7, where the counter I and the cursor pointer KP are incremented. Subsequently in step S8, it is determined whether I≧M (total number of color switches). If the determination in step S8 is NO, the operation returns to step S5, so that the process of steps S5 through S8 is repeated.

In this manner, needle bar numbers are inputted through the key board 20, in accordance with the stitching sequence. The input data is temporarily stored in the work memory 13*b*, and the data is displayed on the CRT display 21 as illustrated in FIG. 10. In FIGS. 9 through 14, data is partially omitted from illustration, and indicated simply a by symbol "-".

When needle bar numbers have been inputted throughout the stitching sequence from the first to Mth places (from I=0 to I=M−1), the determination in step S8 becomes YES, and the operation proceeds to step S9, where it is determined whether a setting end key has been turned on. If complete and the correct color switch setting data is prepared so that there is no need to change any of the needle bar numbers throughout the stitching sequence from the first to Mth places, the operator turns on the setting end key, so that the determination in step S9 becomes YES. Subsequently in step S1O, the color switch setting data wherein the needle bar numbers are in correspondence with the stitching sequence from the first to Mth places is stored into the color switch setting data table.

Figures 9, 10:
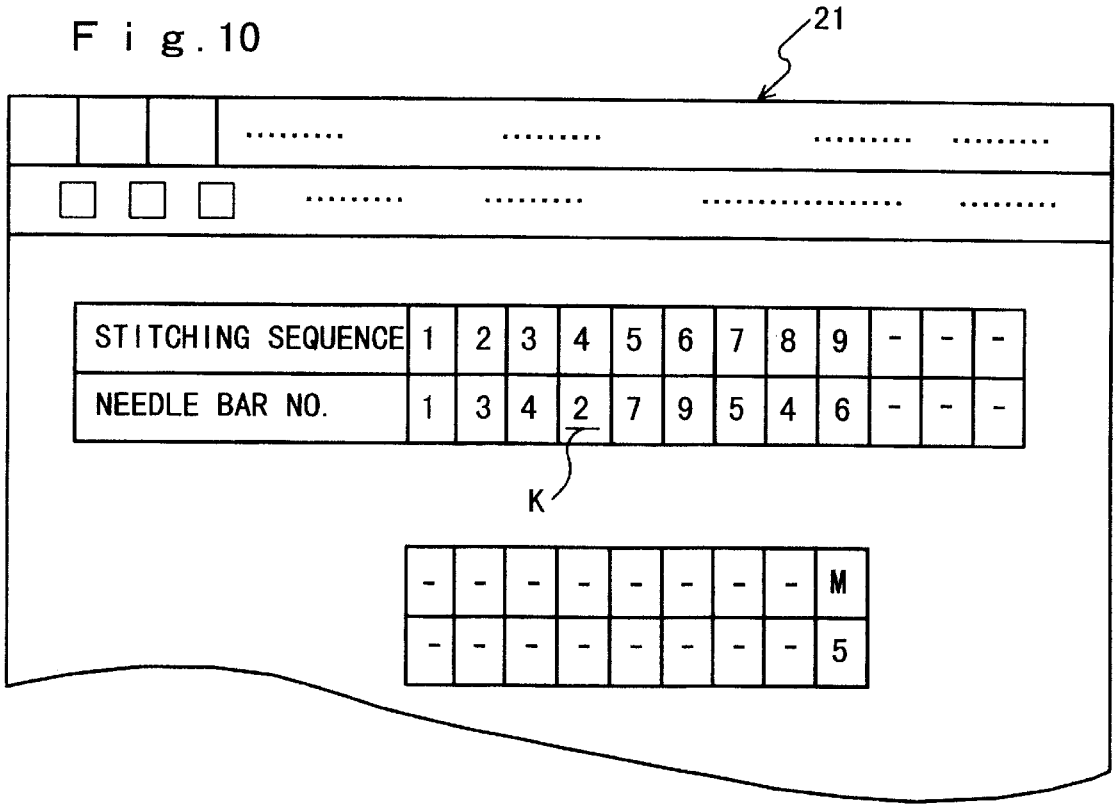
FIG. 9 is a table indicating the relationship among a stitching sequence, input needle bar numbers, counter I and the position of a cursor.
FIG. 10 is an illustration of a table of a stitching sequence and needle bar codes displayed on a CRT display.

However, after inputting the last needle bar number in the stitching sequence, the operator may notice the absence of a needle bar number, that is, realize a need to insert a needle bar number, while checking the input needle bar numbers by looking over the display as shown in FIG. 10. In such a case, the operator will not turn on the setting end key, so that the negative determination (NO) is made in step S9. Then, operation proceeds to step S11. In step S11, the operator moves the cursor K to a place where the operator desires to insert the needle bar number (for example, the forth slot in the stitching sequence row in FIG. 10). Subsequently in step S12, the cursor pointer KP is changed in accordance with the operation of moving the cursor K. In step S13, it is determined whether an insert key has been turned on. When the operator turns on the insert key (YES in step S13), the process of steps S14 through S18 is executed.

In step S14, the counter I is set to its maximum value M−1. In step S15, it is determined whether the count value I of the counter I is equal to KP−2. During an initial period, the determination in step S15 is negative, so that operation proceeds to step S16, where the needle bar number is shifted down by one place in the stitching sequence, that is, the needle bar number at NDL[I−1] is shifted down to NDT,[I], thereby replacing the needle bar number data at NDL[I]. Subsequently in step S17, the counter I is decremented. Then, operation returns to step S15, to repeat the process following step S15. Therefore, the shift-down operation of shifting needle bar numbers down by one place toward the latter side in the stitching sequence is executed serially in the order of needle bar numbers in the places M−1, M−2, . . . When all the needle bar number data in the places up to the place indicated by the cursor K, that is, the needle bar number data in the place indicated by the cursor K and the needle bar number data in the places that follow, have been shifted down by one place in the stitching sequence, the counter I becomes equal to KP−2, so that the determination in step S15 becomes YES. Then, the operation proceeds to step S18.

Figures 11, 12:
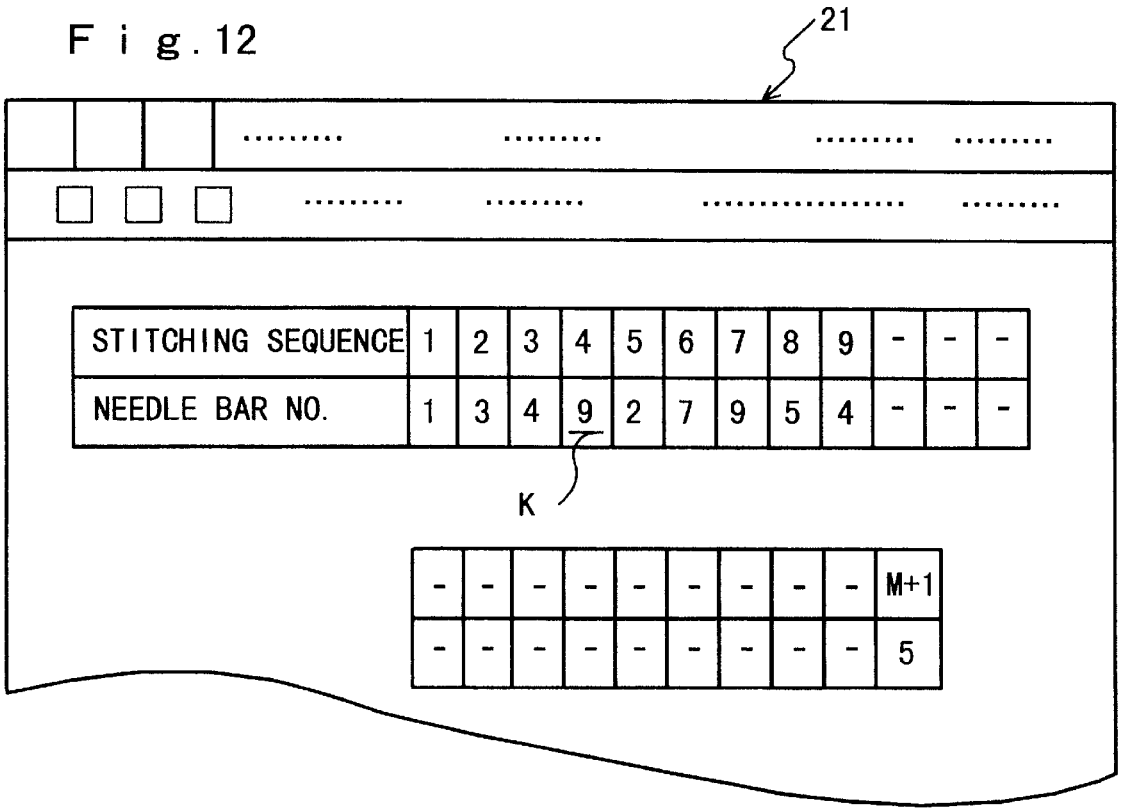
FIG. 11 is a table indicating the relationship among a stitching sequence, input needle bar numbers, counter I and the position of a cursor, after data insertion.
FIG. 12 is an illustration of the table of a stitching sequence and needle bar codes displayed on the CRT display, after data insertion.

In step S18, the operator enters a needle bar number into the insertion place indicated by the cursor K. The operation then proceeds to step S9. If it is determined in step S9 that the setting end key has been turned on, the color switch setting data is stored into the color switch setting data table in step S10. Then, the routine returns. If, for example, a needle bar number "9" is inserted into the fourth place in the stitching sequence by the inserting operation described above, the data content as shown in FIG. 9 changes to the data content as shown in FIG. 11, and the content displayed on the CRT display 21 as shown in FIG. 10 changes to the content as shown in FIG. 12.

In a case where the operator needs to delete a needle bar number after or before a needle bar number inserting operation as described above, the operator moves the cursor K to the place of the needle bar number to be deleted, and turns on a delete key. If the CPU 71 determines in step S20 that the delete key has been turned on (YES in step S20), the process of steps S21 through S25 is executed. In the case of data deletion, needle bar number data is sequentially processed in the order toward the later side in the stitching sequence, starting at the place indicated by the cursor K, in the following manner. First in step S21, KP−1 is set in the counter I. In step S22, it is determined whether the counter I equals M−2. During an initial period, the determination in step S22 is negative, so that operation proceeds to step S23, where the needle bar number is shifted up by one place in the stitching sequence, that is, the needle bar number at the needle bar code [I+1] is shifted up to the needle bar code [I], thereby replacing the needle bar number data corresponding to the needle bar code [I]. Subsequently in step S24, the counter I is incremented. Then, the operation returns to step S22, to repeat the process of steps S22 through S24.

Figures 13, 14:
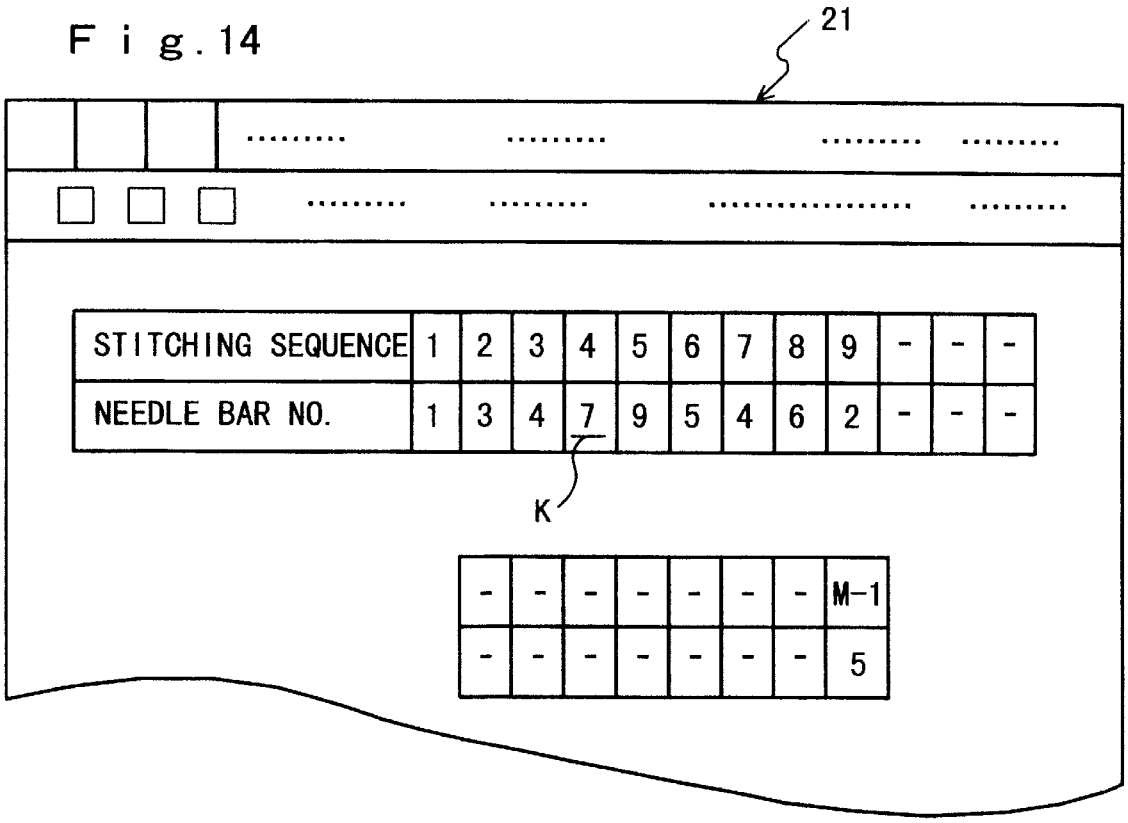
FIG. 13 is a table indicating the relationship among a stitching sequence, input needle bar numbers, counter I and the position of a cursor, after data deletion.
FIG. 14 is an illustration of the table of a stitching sequence and needle bar codes displayed on the CRT display, after data deletion.

In this manner, the shift-up operation of shifting needle bar number data up by one place in the stitching sequence is executed serially in the order of the needle bar number data in the places KP−1, KP, . . . When all the needle bar number data in the places subsequent to the place indicated by the cursor K, that is, on the later side thereof, have been shifted up by one place to the earlier side in the stitching sequence, the counter I becomes equal to M−2, so that the determination in step S22 becomes affirmative. Then, operation proceeds to step S9. If the setting end key is turned on (YES in step S9), the color switch setting data is stored into the color switch setting data table in step S10. Then, the routine returns. If, for example, a needle bar number "2" is deleted from the fourth place in the stitching sequence (FIGS. 9 and 10) by the deleting operation described above, the data content as shown in FIG. 9 changes to the data content as shown in FIG. 13, and the content displayed on the CRT display 21 as shown in FIG. 10 changes to the content as shown in FIG. 14. During the color switch setting data preparing operation described above, the insertion or deletion of a needle bar number can be performed any number of times. The data processing apparatus may also be designed so that the insertion or deletion of a needle bar number can also be performed before all the color switch setting data has been inputted.

Therefore, in the color switch setting data processing for a multi-needle embroidery machine according to the embodiment, it becomes possible to insert a needle bar number at a desired place in the stitching sequence in the color switch setting data or delete a needle bar number from a desired place in the stitching sequence.

Furthermore, at the time of insertion of a needle bar number, the color switch setting data is automatically rewritten simply by designating the place of insertion, producing an insertion instruction and entering the needle bar number into the place of insertion. At the time of deletion of a needle bar number, the color switch setting data is automatically rewritten simply by designating the place of deletion, and producing a deletion instruction. Therefore, the operation of correcting the color switch setting data is considerably simplified and facilitated, so that the operating efficiency in preparation of color switch setting data will significantly improve.

Further, since the color switch setting data is automatically rewritten at the time of insertion or deletion, the reliability of the color switch setting data after data correction improves so that the check of the color switch setting data after correction can be omitted.

The foregoing embodiments may be modified in various ways. For example, although in the foregoing embodiment, the invention is used with a personal computer 2 (a color switch setting data processing apparatus for a multi-needle embroidery machine) for controlling the four embroidery machines 3–6 in the stitching system, the application of the invention is not limited to such a color switch setting data processing apparatus for a multi-needle embroidery machine. For example, the invention may also be applied to a data preparing apparatus, a data editing apparatus and a data processing apparatus for processing stitch data for a multi-needle embroidery apparatus. Furthermore, the invention may also be applied, in substantially the same manner as described above, to a control apparatus for controlling a single multi-needle embroidery machine.

It is to be understood that the invention is not restricted to the particular forms shown in the foregoing embodiment or modifications. Various other modifications and alternations can be made thereto without departing from the scope of the invention.

What is claimed is:

1. A color switch setting data processing apparatus for a multi-needle embroidery machine, for processing color switch setting data to be used for an embroidery operation performed by the multi-needle embroidery machine, comprising:

an input device;

display means including a display for displaying data;

color switch setting data storing means for storing a stitching sequence for forming a plurality of component color design parts of an embroidery design, and needle bar identifiers of needle bars to be used for the individual component color design parts, in correspondence with each other;

display control means for receiving data regarding the stitching sequence and the needle bar identifiers from the color switch setting data storing means, and for displaying, on the display, the stitching sequence and the needle bar identifiers in correspondence with each other;

insertion instruction means for providing an instruction to insert a needle bar identifier into any place in the stitching sequence displayed by the display means; and insertion data update means for, if the instruction to insert a needle bar identifier is provided by the insertion instruction means, rewriting needle bar identifier data in the color switch setting data storing means by shifting the needle bar identifier data in the place of insertion of the needle bar identifier based on the instruction and subsequent places, by one place to a later side in the stitching sequence, and writing the needle bar identifier data inputted by the input means into the place of insertion based on the instruction, into the color switch setting data storing means.

2. The color switch setting data processing apparatus for a multi-needle embroidery machine according to claim 1, further comprising:

deletion instruction means for providing an instruction to delete a needle bar identifier from any place in the stitching sequence displayed by the display means; and deletion data update means for, if the instruction to delete a needle bar identifier is provided by the deletion instruction means, rewriting needle bar identifier data in the color switch setting data storing means by shifting the needle bar identifier data in places subsequent, on the later side, to the place of deletion based on the instruction, by one place to an earlier side in the stitching sequence.

3. The color switch setting data processing apparatus according to claim 2, wherein the needle bar identifiers are needle bar numbers.

4. A color switch setting data processing apparatus for a multi-needle embroidery machine, for processing color switch setting data to be used for an embroidery operation performed by the multi-needle embroidery machine, comprising:

an input unit;

a display unit including a display;

a color switch setting data storage that stores a stitching sequence for forming a plurality of component color design parts of an embroidery design, and needle bar identifiers of needle bars to be used for the individual component color design parts, in correspondence with each other;

a display controller that receives data regarding the stitching sequence and the needle bar identifiers from the color switch setting data storage, and that causes the display of the display unit to display the stitching sequence and the needle bar identifiers in correspondence with each other;

an insertion instruction unit that is operated to provide an instruction to insert a needle bar identifier into any place in the stitching sequence displayed on the display; and an insertion data update unit that, if the instruction to insert a needle bar identifier is provided through the insertion instruction unit, rewrites needle bar identifier data in the color switch setting data storage by shifting the needle bar identifier data in the place of the insertion of the needle bar identifier instructed and subsequent places, by one place to a later side in the stitching sequence, and writes the needle bar identifier data inputted through the input unit into the place of the insertion instructed, into the color switch setting data storage.

5. The color switch setting data processing apparatus for a multi-needle embroidery machine according to claim 4, further comprising:

a deletion instruction unit that provides an instruction to delete a needle bar identifier from any place in the stitching sequence displayed on the display; and a deletion data update unit, if the instruction to delete a needle bar identifier is provided through the deletion instruction unit, rewrites needle bar identifier data in the color switch setting data storage by shifting the needle bar identifier data in places subsequent, on the later side, to the place of the deletion based on the instruction, by one place to an earlier side in the stitching sequence.

6. The color switch setting data processing apparatus according to claim 5, wherein the needle bar identifiers are needle bar numbers.

7. A stitching system, comprising:

a multi-needle embroidery machine; and a color switch setting data processing apparatus for the multi-needle embroidery machine, the color switch setting data processing apparatus including:

an input unit;

a display unit including a display;

a color switch setting data storage that stores a stitching sequence for forming a plurality of component color design parts of an embroidery design, and needle bar identifiers of needle bars to be used for the individual component color design parts, in correspondence with each other;

a display controller that receives data regarding the stitching sequence and the needle bar identifiers from the color switch setting data storage, and that causes the display of the display unit to display the stitching sequence and the needle bar identifiers in correspondence with each other;

an insertion instruction unit that is operated to provide an instruction to insert a needle bar identifier into any place in the stitching sequence displayed on the display; and an insertion data update unit that, if the instruction to insert a needle bar identifier is provided through the insertion instruction unit, rewrites needle bar identifier data in the color switch setting data storage by shifting the needle bar identifier data in the place of the insertion of the needle bar identifier instructed and subsequent places, by one place to a later side in the stitching sequence, and writes the needle bar identifier data inputted through the input unit into the place of the insertion instructed, into the color switch setting data storage.

8. The stitching system according to claim 7, wherein the color switch setting data processing apparatus for the multi-needle embroidery machine further includes:

a deletion instruction unit that provides an instruction to delete a needle bar identifier from any place in the stitching sequence displayed on the display; and a deletion data update unit, if the instruction to delete a needle bar identifier is provided through the deletion instruction unit, rewrites needle bar identifier data in the color switch setting data storage by shifting the needle bar identifier data in places subsequent, on the later side, to the place of the deletion based on the instruction, by one place to an earlier side in the stitching sequence.

9. The stitching system according to claim 8, wherein the needle bar identifiers are needle bar numbers.

10. A data processing apparatus, including a display for creating a color stitch setting sequence for use by a multi-needle embroidery machine, the data processing apparatus comprising:

means for inputting and storing in a recording medium a number of embroidery pattern segments to be sewn to create a finished embroidery pattern;

means for inputting a sewing needle identifier for each segment of the embroidery pattern;

means for controlling a display of the segments with associated sewing needle identifiers;

means for correcting a sewing needle identifier incorrectly associated with a segment, the means for correcting including:

means for at least one of inserting and deleting the needle identifier associated with the segment; and means for finalizing and storing in the recording medium sewing data for sewing the embroidery pattern to include the needle identifiers associated with the segments of the embroidery pattern.

11. The data processing apparatus according to claim 10, wherein the correcting means overwrites the needle identifier with a new needle identifier.

12. The data processing apparatus according to claim 10, wherein the correcting means, when a new needle identifier is inserted, moves each previously input needle identifier starting at the position of insertion to a next sequential segment.

13. The data processing apparatus according to claim 10, wherein the correcting means, when a previously input needle identifier is deleted, moves each subsequent previously input needle identifier to be associated with a next previous segment.

14. A storage medium that stores a control program for use by a display to create a color stitch setting sequence for use by a multi-needle embroidery machine, the control program including instructions for:

accessing a number of embroidery pattern segments to be sewn to create a finished embroidery pattern;

inputting a sewing needle identifier for each segment of the embroidery pattern;

controlling a display of the segments with associated sewing needle identifiers; and correcting a sewing needle identifier incorrectly associated with a segment, including inserting and deleting the sewing needle identifier associated with the segment and finalizing and storing sewing data for sewing the embroidery pattern, including the needle identifiers associated with the segments of the embroidery pattern.

15. The storage medium of claim 14, wherein correcting includes overwriting the needle identifier with a new needle identifier.

16. The storage medium according to claim 14, wherein correcting includes moving each previously input needle identifier starting at the position of insertion to a next sequential segment when a new needle identifier is inserted.

17. The storage medium according to claim 14, wherein correcting includes moving each subsequent previously input needle identifier into association with a next previous segment if a previously input needle identifier is deleted.

18. The storage medium according to claim 14, wherein accessing the number of embroidery pattern segments includes retrieving the number of embroidery pattern segments from a removable storage medium.

19. The storage medium according to claim 18, wherein the storage medium is a fixed storage medium, and the removable storage medium is a floppy disk.

20. The storage medium according to claim 14, wherein the storage medium is a fixed storage medium and the control program is uploaded from a removable storage medium.

* * * * *